US009126217B2

(12) United States Patent
Nolte et al.

(10) Patent No.: US 9,126,217 B2
(45) Date of Patent: Sep. 8, 2015

(54) INK JET FOR A BELL PLATE OF A ROTARY ATOMIZER

(75) Inventors: Hans-Jürgen Nolte, Besigheim (DE); Robert Heldt, Oxford, MI (US)

(73) Assignee: Durr Systems GmbH, Bietigheim-Bissingen (DE)

( * ) Notice: Subject to any disclaimer, the term of this patent is extended or adjusted under 35 U.S.C. 154(b) by 760 days.

(21) Appl. No.: 13/390,395

(22) PCT Filed: Aug. 2, 2010

(86) PCT No.: PCT/EP2010/004714

§ 371 (c)(1), (2), (4) Date: Feb. 14, 2012

(87) PCT Pub. No.: WO2011/018169

PCT Pub. Date: Feb. 17, 2011

(65) Prior Publication Data

US 2012/0137968 A1 Jun. 7, 2012

(30) Foreign Application Priority Data

Aug. 14, 2009 (DE) ..... 10 2009 037 604

(51) Int. Cl.
*B05B 15/02* (2006.01)
*B05B 3/10* (2006.01)

(52) U.S. Cl.
CPC ..... *B05B 15/025* (2013.01); *B05B 3/1014* (2013.01); *B05B 3/1064* (2013.01); *B05B 15/0275* (2013.01)

(58) Field of Classification Search
CPC ..... B05B 15/025; B05B 15/0275; B05B 15/0283; B05B 3/1064; B05B 3/1014
USPC ..... 239/112, 223, 700–708, 224
See application file for complete search history.

(56) References Cited

U.S. PATENT DOCUMENTS 4,505,430 A 3/1985 Rodgers et al.
5,707,009 A * 1/1998 Schneider ..... 239/112

(Continued)

FOREIGN PATENT DOCUMENTS

DE 8708489 U1 9/1987
EP 0715896 A2 6/1996

(Continued)

OTHER PUBLICATIONS

International Search Report, PCT/EP2010/004714, Dated May 11, 2010.

*Primary Examiner* — Dinh Q Nguyen
(74) *Attorney, Agent, or Firm* — Bejin Bieneman PLC

(57) ABSTRACT

An ink jet is disclosed that may be placed in a bell plate of a rotary atomizer and, when thus placed, forms an annular gap between the ink jet and a distribution disc recess of the bell plate. An exemplary illustration has a common rinsing agent channel running in the ink jet for conducting a rinsing agent for rinsing the bell plate, a first rinsing agent outlet that is supplied with rinsing agent by the common rinsing agent channel and directed forward in a substantially axial direction toward a distribution disc of the bell plate, and a second rinsing agent outlet that is supplied with rinsing agent by the common rinsing agent channel. In the installed state, an exemplary second rinsing agent outlet may empty into the annular gap between the distribution disc recess and the ink jet in order to clean the annular gap with the rising agent.

31 Claims, 5 Drawing Sheets

(56) References Cited

U.S. PATENT DOCUMENTS

| | | | | |
|---|---|---|---|---|
| 6,341,734 | B1 | 1/2002 | Van Der Steur | |
| 7,861,945 | B2 * | 1/2011 | Yasuda et al. | 239/112 |
| 2008/0277496 | A1 | 11/2008 | Yasuda et al. | |
| 2009/0295722 | A1 | 12/2009 | Yamamoto | |
| 2010/0193602 | A1 * | 8/2010 | Ballu et al. | 239/224 |

FOREIGN PATENT DOCUMENTS

| | | | |
|---|---|---|---|
| JP | 08332415 | A | 1/2010 |
| JP | 4850803 | B2 | 1/2012 |

* cited by examiner

INK JET FOR A BELL PLATE OF A ROTARY ATOMIZER

CROSS-REFERENCES TO RELATED APPLICATIONS

This application is a National Stage application which claims the benefit of International Application No. PCT/EP2010/004714 filed Aug. 2, 2010, which claims priority based on German Application No. DE 10 2009 037 604.6, filed Aug. 14, 2009, both of which are hereby incorporated by reference in their entireties.

FIELD

The present disclosure relates to a paint nozzle, e.g., which can be inserted into a bell cup of a rotary atomizer.

BACKGROUND

FIG. 1 shows a conventional rotary atomizer 1, which can be used for example in a painting installation for painting motor vehicle body parts. The rotary atomizer 1 has a hollow turbine shaft 2, which is driven by a turbine and bears a bell cup 3 at its free end, the bell cup 3 being screw-fastened to the turbine shaft 2. A hollow paint tube 4 runs in the hollow turbine shaft 2, through which paint tube the paint to be applied is conveyed to the bell cup 3. A replaceable paint nozzle 5 is attached to the end face of the paint tube 4, which paint nozzle projects with its nozzle head axially through the bell cup 3 and directs the paint stream onto a distributor disc 6. Furthermore, the rotary atomizer 1 has a guide air ring 7, which has numerous guide air nozzles 8, which are distributed over the circumference and direct a guide air stream axially from behind e.g. onto a lateral surface 9 of the bell cup 3 in order to shape the spray jet output by the bell cup 3. The rotary atomizer 1 also allows a cleaning mode in that a rinsing agent is supplied instead of the paint via the paint tube 4 and the paint channel 10 running therein, which rinsing agent then cleans the inner surface of the bell cup 3 and the distributor disc 6.

A disadvantage of this known design is that the outer lateral surface 9 of the bell cup 3 cannot be cleaned with rinsing agent. On the other hand, a disadvantage of this design is that brief rinsing, during which the coating continues to be pushed as far as the paint nozzle 5 without interruption and only the bell cup 3 is briefly rinsed in between in order to prevent the coating drying on, is not possible.

FIG. 2 shows a likewise known conventional design of a bell cup 3 which partly corresponds to the design according to FIG. 1 described above, so reference is made to the above description, the same reference numerals being used for corresponding details, to avoid repetition. A similar design is also known from U.S. Pat. No. 6,341,734 B1.

A particular feature of this known design is that the paint nozzle 5 has, in addition to the continuous paint channel 10, a rinsing agent channel 11, which ends in a rinsing agent outlet in the front end face of the paint nozzle 5 and directs the rinsing agent essentially axially onto the distributor disc 6. The separation of the rinsing agent channel 11 from the paint channel 10 makes the above-described brief rinsing possible, as the coating can continue to be pushed as far as the paint nozzle 5 even during the rinsing process. A further particular feature of this known design is that the lateral surface 9 of the bell cup 3 can also be rinsed. To this end, a rinsing agent bore 12 branches off from the common rinsing agent channel 11, which bore conducts the rinsing agent through a further rinsing agent channel 13 in the bell cup 3 into an annular outer rinsing chamber of the bell cup 3, from where the rinsing agent then passes onto the outer lateral surface 9 of the bell cup 3. This external rinsing is also generally disclosed in EP 0 715 896 A2.

The disadvantage of this known design is the fact that when the rinsing agent pressure is too low, only the rear of the distributor disc 6 opposite the paint nozzle 5 is cleaned, while a distributor disc receptacle 15 contains dirt because the rinsing agent turbulences and the rebound of the rinsing agent from the distributor disc 6 are not sufficient to clean the distributor disc receptacle 15 completely with rinsing agent as well.

FIG. 3 likewise shows a known design of a bell cup 3 which partly corresponds to the conventional bell cups 3 described above, so reference is made to the above description, the same reference numerals being used for corresponding details, to avoid repetition.

A particular feature of this design is that the rinsing agent channel 11 opens into rinsing agent outlets which are axially offset to the rear in relation to the front end face of the paint nozzle 5.

A disadvantage of this design with axially set back rinsing agent outlets is however the insufficient cleaning of the central bore in the distributor disc receptacle 15 and the paint nozzle 5.

Finally, reference is also made to US 2008/0277496 A1. This document, while disclosing a wash passage for a rotary spraying head, also suffers from the disadvantage that an annular gap between a paint nozzle and a distributor disc receptacle surrounding it in an annular manner is not sufficiently rinsed during the washing process.

Accordingly, there is a need for a correspondingly improved paint nozzle.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
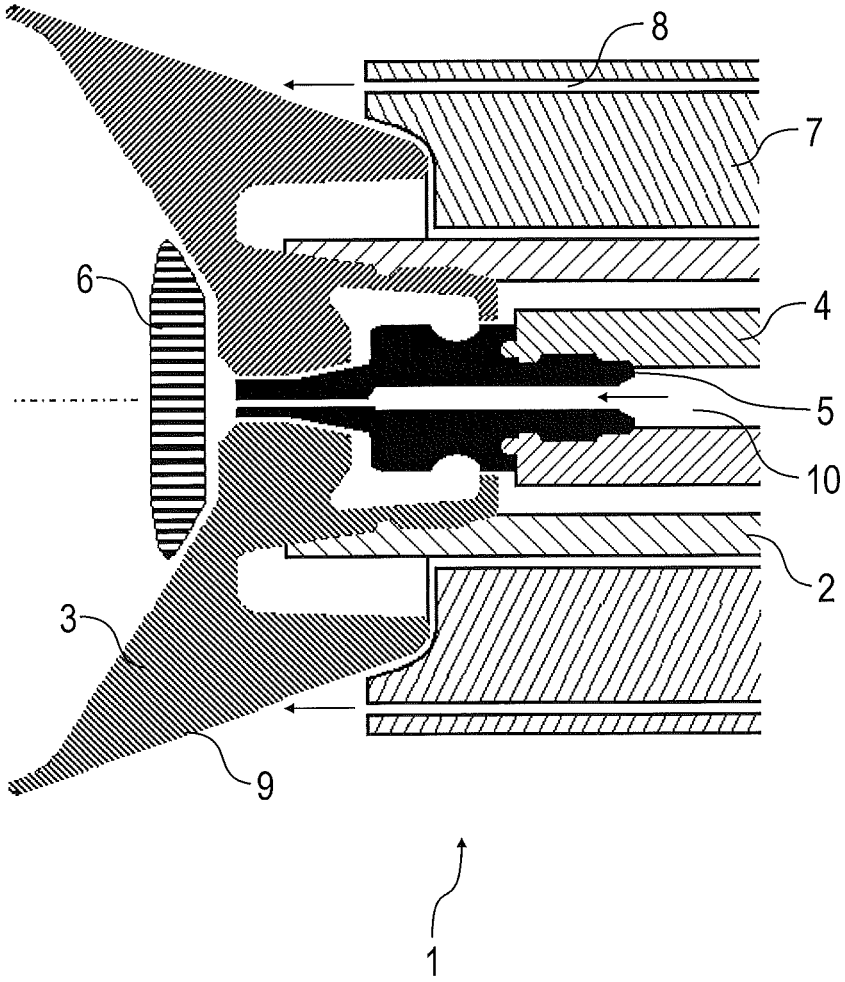
Fig. 1 Prior art
FIG. 1 a cross-sectional view of a conventional bell cup having a paint nozzle without an additional rinsing agent channel, FIG. 2 a cross-sectional view of a conventional bell cup having a paint nozzle with a separate rinsing agent channel which also allows external rinsing, FIG. 3 a cross-sectional view of a conventional bell cup with rinsing agent outlets which are axially set back, FIG. 4A a cross-sectional view of a paint nozzle according to an exemplary illustration.
Figure 2:
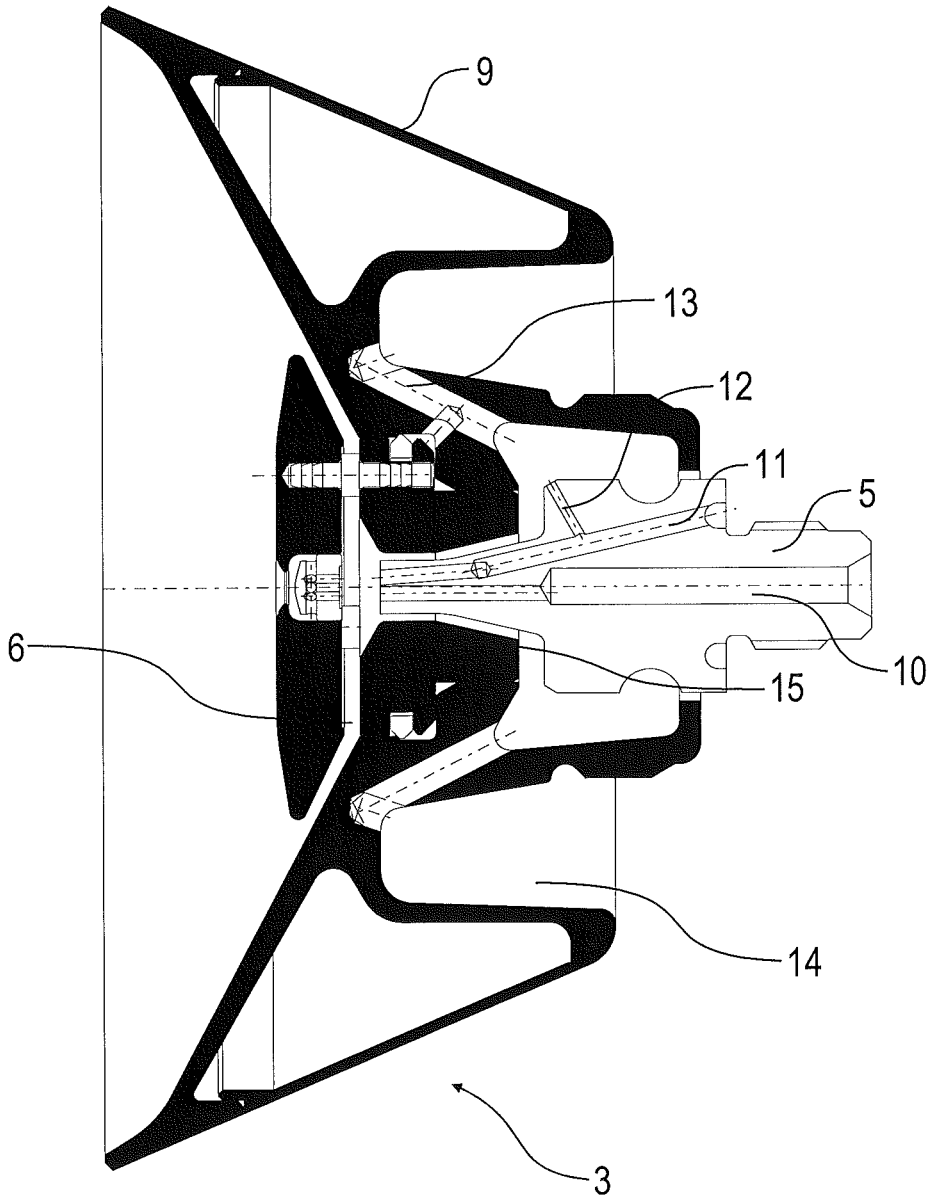
Fig. 2 Prior art
Figure 3:
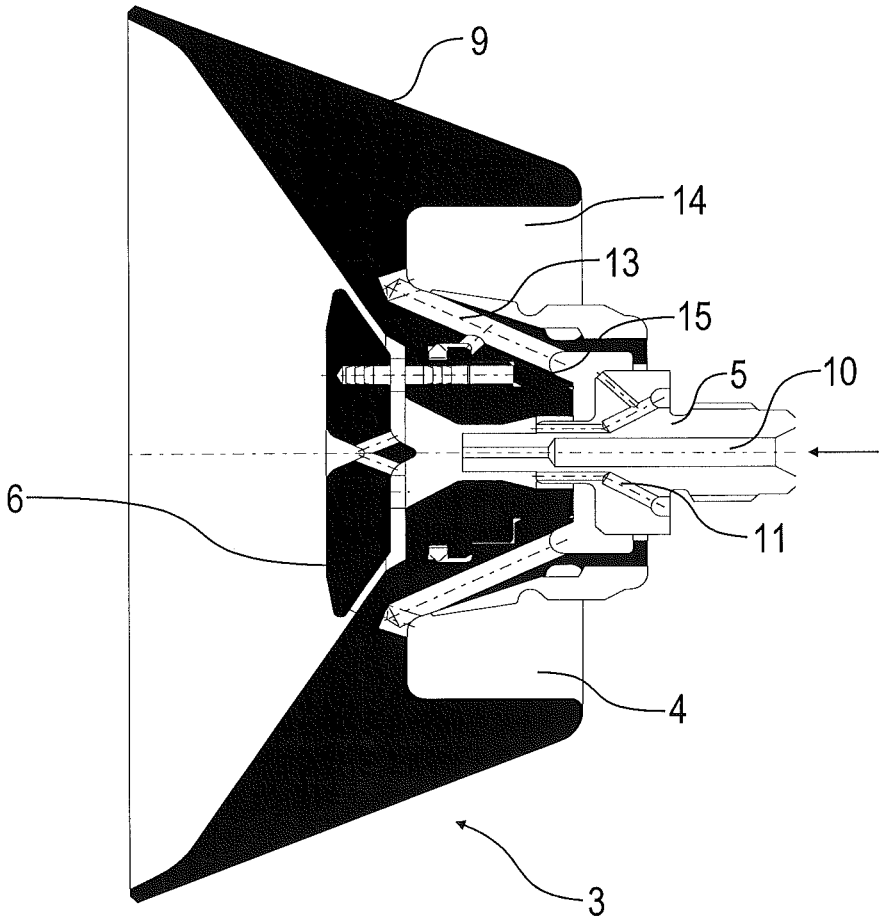
Fig. 3 Prior art

The paint nozzle according to the exemplary illustrations may allow brief rinsing and furthermore achieve a satisfactory cleaning effect inside the entire bell cup, on the distributor disc, paint nozzle, outer lateral surface of the bell cup and the distributor disc receptacle, if this is not part of the bell cup.

Various exemplary illustrations of an ink jet are disclosed that may be placed in a bell plate of a rotary atomizer and, when thus placed, forms an annular gap between the ink jet and a distribution disc recess of the bell plate. An exemplary illustration has a common rinsing agent channel running in the ink jet for conducting a rinsing agent for rinsing the bell plate, a first rinsing agent outlet that is supplied with rinsing agent by the common rinsing agent channel and directed forward in a substantially axial direction toward a distribution disc of the bell plate, and a second rinsing agent outlet that is supplied with rinsing agent by the common rinsing agent channel. In the installed state, an exemplary second rinsing agent outlet may empty into the annular gap between the distribution disc recess and the ink jet in order to clean the annular gap with the rising agent.

The exemplary illustrations are based on the physical finding that the rinsing agent outlets arranged at the end in the paint nozzle can clean the distributor disc in a satisfactory manner but not the annular gap between the paint nozzle and the surrounding distributor disc.

Furthermore, the exemplary illustrations are based on the physical finding that axially setting back the rinsing agent outlets results in an impairment of the cleaning effect on the distributor disc.

The exemplary illustrations therefore comprise the general technical teaching of providing separate rinsing agent outlets in the paint nozzle, which outlets should clean the distributor disc and the annular gap between the paint nozzle and the surrounding distributor disc receptacle (i.e. generally the bell cup), which allows simultaneous cleaning.

An exemplary paint nozzle therefore may comprise a common rinsing agent channel for conducting a rinsing agent for rinsing the bell cup, e.g., in a conventional manner. This rinsing agent channel may open into a first rinsing agent outlet which is used for rinsing the distributor disc and directs the rinsing agent essentially axially forwards onto the distributor disc of the bell cup. Furthermore, an exemplary paint nozzle may have a second rinsing agent outlet which, when the paint nozzle is in the mounted state, opens into the annular gap between the distributor disc recess and the paint nozzle in order to clean this annular gap with the rinsing agent. An exemplary paint nozzle therefore may have a common rinsing agent channel which branches in the paint nozzle and supplies separate rinsing agent outlets with the rinsing agent.

In addition to the two rinsing agent outlets described above for rinsing the distributor disc and for rinsing the annular gap between the paint nozzle and the distributor disc receptacle, the paint nozzle may have a third rinsing agent outlet which is likewise supplied with the rinsing agent by the common rinsing agent channel and allows external rinsing, e.g., as described in EP 0 715 896 A2 and corresponding U.S. Pat. No. 5,707,009, each of which are hereby expressly incorporated by reference in their entireties, including the description therein directed to the design details of the external rinsing.

In one exemplary illustration, the common rinsing agent channel therefore branches into at least three different rinsing agent outlets, which may rinse different regions of the bell cup. The first rinsing agent outlet on the end face of the paint nozzle may therefore be used primarily for rinsing the distributor disc and the bell cup inner surface. The second rinsing agent outlet may however be used mainly for rinsing the annular gap between the paint nozzle and the surrounding distributor disc receptacle. The third rinsing agent outlet may however be used mainly for external rinsing, i.e. for rinsing the outer lateral surface of the bell cup.

An exemplary paint nozzle may be designed in such a manner that the rinsing agent stream supplied via the common rinsing agent channel is divided into a plurality of sub-streams, which have a certain ratio with respect to each other and are supplied to the respective rinsing agent outlets.

The first rinsing agent outlet for rinsing the distributor disc and the inner surface of the bell cup therefore may output a proportion of 3/7-5/7 of the total rinsing agent volumetric flow, which generally corresponds to a rinsing agent volumetric flow of 360-440 ml/min. In one known example, the first rinsing agent outlet outputs a proportion of 4/7 of the total rinsing agent stream. This depends on the rinsing agent pressure and tubing and can therefore be greater or less than the above-mentioned value range.

The second rinsing agent outlet for rinsing the annular gap between the distributor disc receptacle and the paint nozzle however may output a proportion of less than 2/7 of the total rinsing agent quantity, which corresponds to a rinsing agent quantity of up to 110 ml/min. In the example referenced above, the second rinsing agent outlet outputs a proportion of 1/7 of the total rinsing agent quantity.

The third rinsing agent outlet for external rinsing however may output a proportion of 1/7-3/7 of the total rinsing agent quantity, which corresponds to a rinsing agent quantity of 180-220 ml/min. In the example referenced above, the proportion for external rinsing 2/7 of the total rinsing agent quantity.

The total rinsing agent quantity is in this case may be in a range of 10-40 ml.

The above-mentioned division of the rinsing agent stream into the different sub-streams may be achieved by corresponding structural shaping and dimensioning of the rinsing agent outlets and the upstream rinsing agent bores.

The second rinsing agent outlet for rinsing the annular gap between the paint nozzle and the surrounding distributor disc receptacle therefore may have a diameter which is less than 1 mm, 0.7 mm, 0.5 mm or even less than 0.35 mm. This means that only a relatively small quantity of rinsing agent is branched off via the second rinsing agent outlet, so enough rinsing agent remains for rinsing the other regions of the bell cup.

It should also be mentioned that the second rinsing agent outlet for rinsing the annular gap between the distributor disc receptacle and the paint nozzle may be arranged at a certain axial distance behind the front of the paint nozzle. The second rinsing agent outlet may therefore be axially set back in relation to the front end face of the paint nozzle, the axial distance from the front of the paint nozzle may be in a range of 4-5 mm. In one known example, the distance between the front of the paint nozzle and the second rinsing agent outlet is 4.5 mm+/−0.2 mm. This ensures that more than half of the inner surface of the distributor disc receptacle is cleaned and no rinsing agent passes backwards in the direction of the paint tube or to the external rinsing bores.

It should further be mentioned that the second rinsing agent outlet may output the rinsing agent obliquely forwards and outwards, the rinsing agent outlet having a certain exit angle in relation to the axis of rotation of the bell cup. The exit angle of the second rinsing agent outlet may be in the range of 0-15°, and in one example the exit angle is essentially 3°. It is also possible within the scope of the exemplary illustrations for the exit angle to be 0°.

In one known example, the common rinsing agent channel has an upstream duct section and a downstream duct section, the upstream duct section having a larger duct cross section than the downstream duct section. The common rinsing agent channel thus may expand with a step, the second rinsing agent outlet for rinsing the annular gap between the distributor disc receptacle and the paint nozzle may branch off from the upstream duct section of the common rinsing agent channel, i.e. from the duct section with the greater duct cross section. It should also be mentioned in this respect that the second rinsing agent outlet for rinsing the annular gap may branch off at the transition from the upstream, larger duct cross section to the downstream, smaller duct cross section of the common rinsing agent channel, which has proven favourable in terms of flow.

Alternatively, it is also possible for the second rinsing agent outlet for rinsing the annular gap between the distributor disc receptacle and the paint nozzle to branch off from the downstream duct section of the common rinsing agent channel.

The third rinsing agent outlet for external rinsing however may branch off from the upstream duct section of the common rinsing agent channel, where the rinsing agent channel has a greater duct cross section.

The first rinsing agent outlet for rinsing the distributor disc may be arranged at the end face of the paint nozzle and/or at the end of the downstream duct section.

It should furthermore be mentioned that a coating agent channel may generally run in the axial direction in the paint nozzle in order to conduct the coating agent to be applied, the coating agent channel, for example, passing axially through the entire length of the paint nozzle and ending in an outlet bore in the front end face of the paint nozzle. The coating agent channel may also be divided into an upstream duct section with a greater duct cross section and a downstream duct section with a smaller duct cross section, it being possible for the downstream duct section with the smaller duct cross section to run eccentrically in the paint nozzle in order to leave enough space at the side for the first rinsing agent outlet.

Alternatively, it is possible for the upstream duct section of the coating agent channel to have a smaller duct cross section than the downstream duct section.

It is also possible for the coating agent channel to be tapered or widened in conical manner.

It has already been mentioned above that the second rinsing agent outlet provided according to the exemplary illustrations may be used to rinse the annular gap between the paint nozzle and the surrounding distributor disc receptacle. It should be mentioned in this respect that an exemplary paint nozzle may have two cylindrical nozzle section, between which a conical nozzle section is optionally arranged, the annular gap which is cleaned by the second rinsing agent outlet surrounding the conical nozzle section in an annular manner. The conical nozzle section of the paint nozzle can in this case have a cone angle which can for example lie in the range of 20-30°. It should furthermore be mentioned that the conical nozzle section may, for example, merge into the distal cylindrical nozzle section without steps, whereas a step can occur at the transition from the conical nozzle section to the proximal cylindrical nozzle section.

The term "annular gap" used in the context of the exemplary illustration may therefore be based on an annular gap which surrounds a conical nozzle section of the paint nozzle. In this case the additional second rinsing agent outlet may open out of the lateral surface of the conical nozzle section in order to output the rinsing agent directly into the annular gap.

It should also be mentioned that the exemplary illustrations are not restricted to the exemplary paint nozzles described above as an individual component. Rather, the exemplary illustrations also comprise a bell cup with a paint nozzle situated therein and a complete rotary atomizer having such a bell cup.

It should also be mentioned that the distributor disc in the exemplary bell cups can be a permanent part of the bell cup. It is however also possible for the distributor disc to be formed as a separate component and mounted in the bell cup.

Finally, the exemplary illustrations also comprise a painting installation having at least one such rotary atomizer containing an exemplary paint nozzle.

Figure 4A:
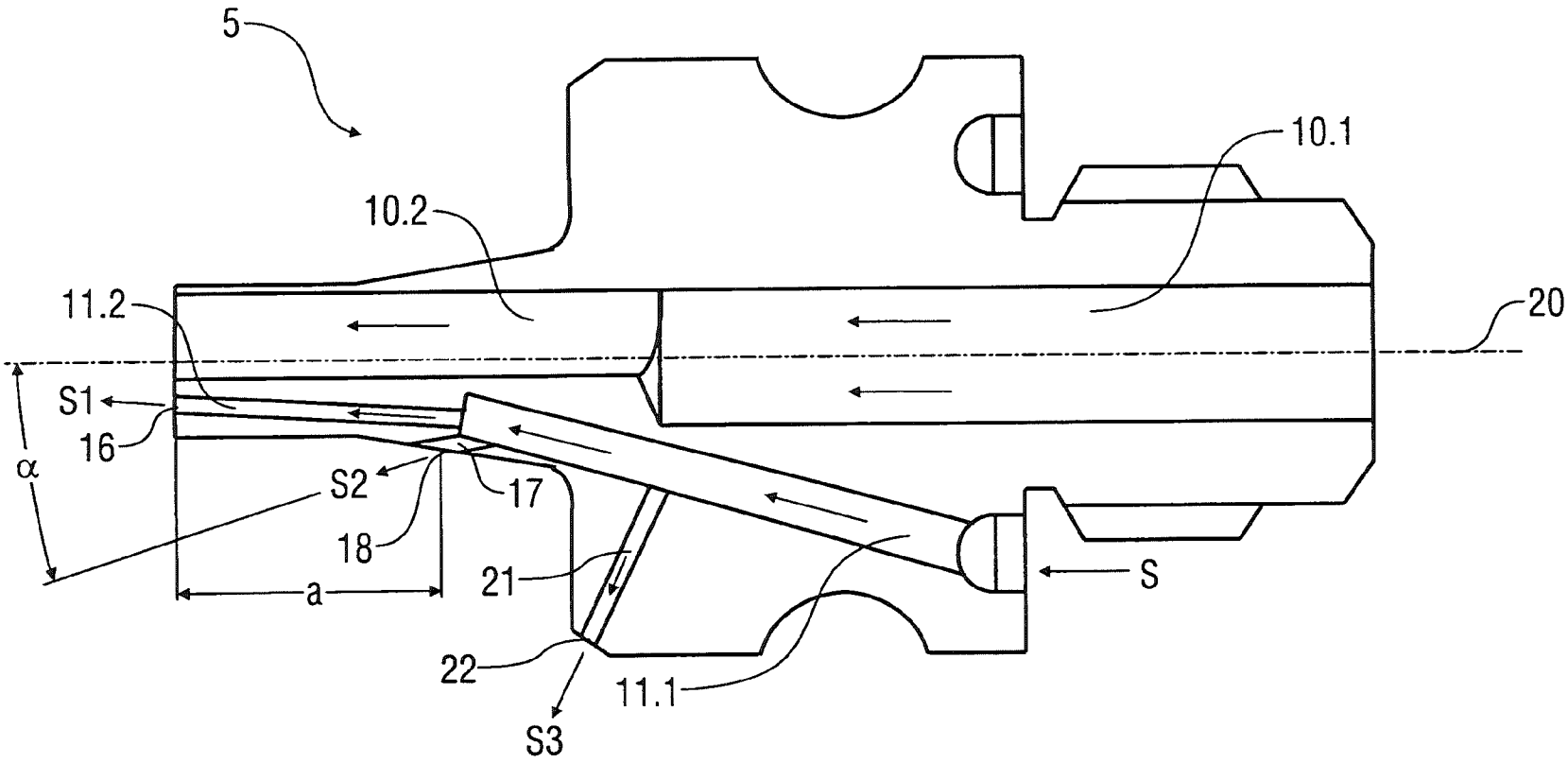
FIG. 4B the exemplary paint nozzle of FIG. 4A with the surrounding distributor disc receptacle shown schematically, according to an exemplary illustration.
Figure 4B:
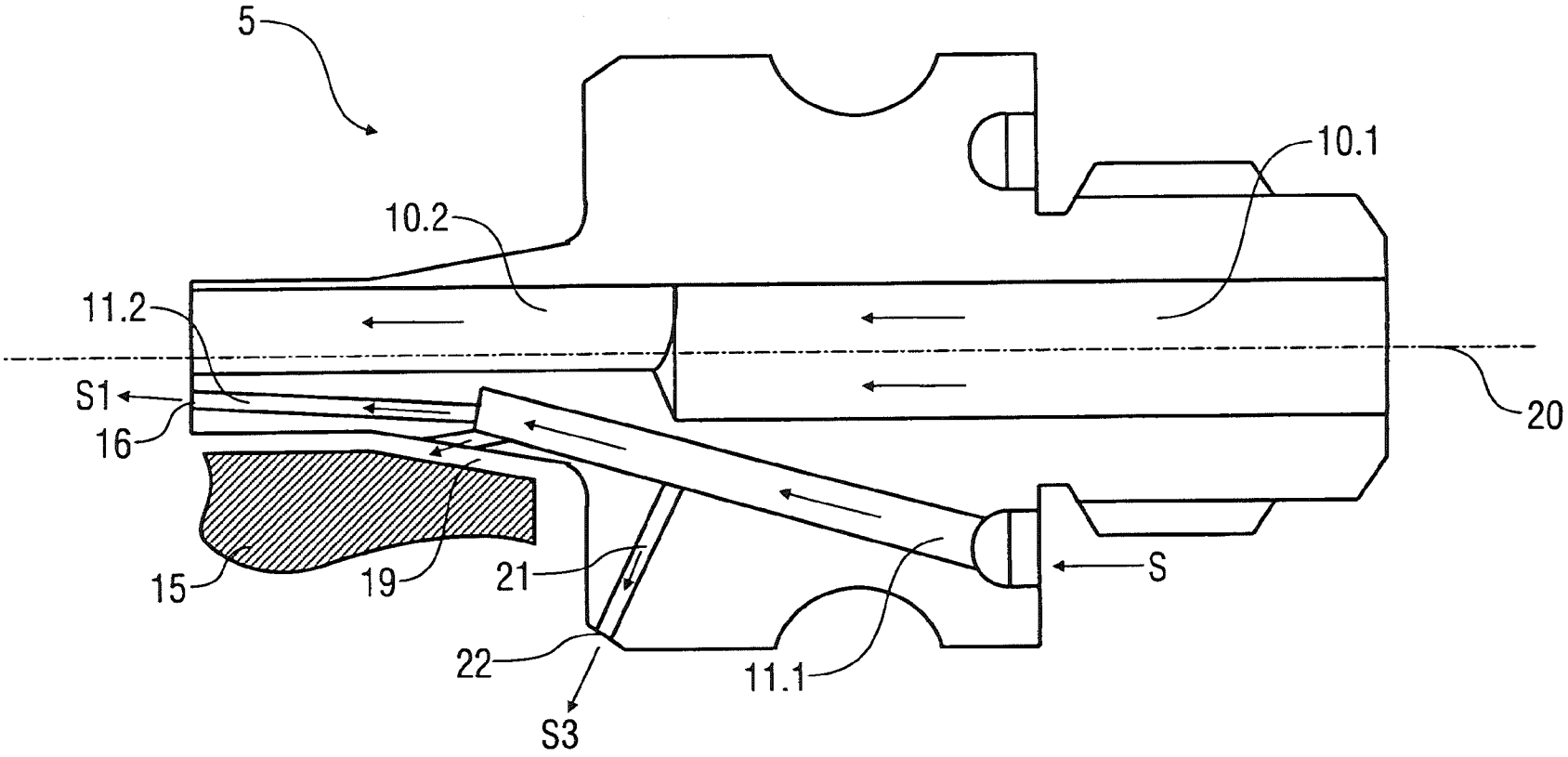

The exemplary paint nozzle 5 shown in FIGS. 4A and 4B partly corresponds to the conventional paint nozzles 5 described in the introduction, so reference is made to the above description, the same reference numerals being used for corresponding details, to avoid repetition.

The paint nozzle 5 has a paint channel 10 which passes through axially and consists of two duct sections 10.1, 10.2 arranged one behind the other. The downstream duct section 10.2 of the paint channel 10 has in this exemplary illustration a smaller duct cross section than the upstream duct section 10.1 of the paint channel, which can however also be realized differently in practice. Furthermore, the downstream duct section 10.2 of the paint channel 10 may be arranged eccentrically in the front part of the paint nozzle 5 in order to leave enough space there for routing the rinsing agent channel 11.

The rinsing agent channel 11 also may have an upstream duct section 11.1 and a downstream duct section 11.2, the downstream duct section 11.2 having a smaller duct cross section than the upstream duct section 11.1.

The downstream duct section 11.2 of the rinsing agent channel 11 then may open into a rinsing agent outlet 16, which is arranged in the front end face of the paint nozzle 5 and outputs a first rinsing agent stream Si essentially axially, the first rinsing agent stream S1 essentially being used to clean the distributor disc 6 and the inner surfaces of the bell cup 3 with the rinsing agent.

Furthermore, a rinsing agent bore branches off from the upstream duct section 11.1 of the rinsing agent channel 11, which bore opens into a second rinsing agent outlet 18, the second rinsing agent outlet 18 outputting a second rinsing agent stream S2, which may be essentially used to rinse an annular gap 19 (cf. FIG. 4B) between the paint nozzle 5 and the surrounding distributor disc receptacle 15.

The second rinsing agent outlet 18 is, in this exemplary illustration, axially set back in relation to the front end face of the paint nozzle 5 by a distance a=4.5 mm. This ensures that more than half of the inner surface of the distributor disc receptacle 15 is cleaned and no rinsing agent passes backwards.

It should also be mentioned that the second rinsing agent outlet may have a certain exit angle $\alpha=3°$ in relation to the axis of rotation 20 of the bell cup 3.

Finally, a further rinsing agent bore 21 may branch off from the upstream duct section 11.1 of the rinsing agent channel 11, which bore opens out in a further rinsing agent outlet 22. A third rinsing agent stream S3, which is used for external rinsing of the bell cup 3, is output via the rinsing agent outlet 22.

The dimensions of the rinsing agent outlets 16, 18 and 22 and of the rinsing agent bores 17, 21 and of the duct sections 11.1, 11.2 of the rinsing agent channel 11 are such that a rinsing agent stream S which is supplied on the input side is divided into the individual rinsing agent streams S1, S2 and S3 in the following ratio:

$$S1=4/7*S,$$

$$S2=1/7*S,$$

$$S3=2/7*S.$$

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

The invention claimed is:

1. A paint nozzle, which can be inserted into a bell cup of a rotary atomizer and, when in the inserted state, forms an annular gap between the paint nozzle and a distributor disc receptacle of the bell cup, comprising:

a common rinsing agent channel which runs in the paint nozzle for conducting a rinsing agent for rinsing the bell cup, a first rinsing agent outlet, which is supplied with the rinsing agent by the common rinsing agent channel and is directed essentially axially forward onto a distributor disc of the bell cup, and a second rinsing agent outlet, which is supplied with the rinsing agent by the common rinsing agent channel, wherein the second rinsing agent outlet, when in the mounted state, opens into the annular gap between the distributor disc receptacle and the paint nozzle in order to clean the annular gap with the rinsing agent; and further wherein the bell cup has an external rinsing chamber in order to allow external rinsing of the bell cup with the coating agent, the paint nozzle has a third rinsing agent outlet, which is supplied with the rinsing agent by the common rinsing agent channel, and the third rinsing agent outlet conducts the rinsing agent into the external rinsing chamber.

2. The paint nozzle according to claim 1, wherein the common rinsing agent channel supplies a predetermined quantity of the rinsing agent, the first rinsing agent outlet for rinsing the distributor disc outputs a first proportion of the quantity of rinsing agent, the second rinsing agent outlet for rinsing the annular gap between the distributor disc receptacle and the paint nozzle outputs a second proportion of the quantity of rinsing agent, and the third rinsing agent outlet for external rinsing outputs a third proportion of the quantity of rinsing agent.

3. The paint nozzle according to claim 2, wherein the total quantity supplied by the common rinsing agent channel is in a range of 10-40 ml (milliliters).

4. The paint nozzle according to claim 2, wherein the flow rate outputted by the first rinsing agent outlet is in a range of 360-440 ml/min (milliliters per minute), the flow rate outputted by the second rinsing agent outlet is in a range of 90-110 ml/min (milliliters per minute), and the flow rate outputted by the third rinsing agent outlet is in a range of 180 ml-220 ml/min (milliliters per minute).

5. The paint nozzle according to claim 2, wherein the first proportion outputted by the first rinsing agent outlet is in a range of 1/7 to 3/7, the second proportion outputted by the second rinsing agent outlet is less than 1/7, and the third proportion outputted by the third rinsing agent outlet is in a range of 1/7 to 3/7.

6. The paint nozzle according to claim 1, wherein the second rinsing agent outlet for rinsing the annular gap between the distributor disc receptacle and the paint nozzle has a diameter which is smaller than 1 mm (millimeter).

7. The paint nozzle according to claim 1, wherein the second rinsing agent outlet for rinsing the annular gap between the distributor disc receptacle and the paint nozzle is arranged at a predetermined axial distance behind a front of the paint nozzle, the predetermined axial distance is greater than 2 mm (millimeters), and the predetermined axial distance is less than 7 mm (millimeters).

8. The paint nozzle according to claim 7, wherein the distance is essentially 4.5 mm (millimeters).

9. The paint nozzle according to claim 1, wherein the rinsing agent is output obliquely forwards and outwards from the second rinsing agent outlet.

10. The paint nozzle according to claim 9, wherein the rinsing agent exits from the second rinsing agent outlet at a predetermined exit angle in relation to the axis of rotation of the bell cup, and the exit angle is less than 25°.

11. The paint nozzle according to claim 10, wherein the angle is about 3°.

12. The paint nozzle according to claim 1, wherein the common rinsing agent channel has an upstream duct section and a downstream duct section, wherein the upstream duct section has a greater duct cross section than the downstream duct section.

13. The paint nozzle according to claim 12, wherein the second rinsing agent outlet for rinsing the annular gap between the distributor disc receptacle and the paint nozzle branches off from the upstream duct section of the common rinsing agent channel.

14. The paint nozzle according to claim 12, wherein the second rinsing agent outlet for rinsing the annular gap between the distributor disc receptacle and the paint nozzle branches off from the common rinsing agent channel at a transition between the upstream duct section and the downstream duct section.

15. The paint nozzle according to claim 12, wherein the third rinsing agent outlet for external rinsing branches off from the upstream duct section of the common rinsing agent channel.

16. The paint nozzle according to claim 12, wherein the first rinsing agent outlet for rinsing the distributor disc is arranged at an end face of the paint nozzle.

17. The paint nozzle according to claim 12, wherein the first rinsing agent outlet for rinsing the distributor disc is arranged at an end of the downstream duct section.

18. The paint nozzle according to claim 1, wherein a coating agent channel runs axially in the paint nozzle in order to conduct a coating agent to be applied.

19. The paint nozzle according to claim 18, wherein the coating agent channel passes axially through an entire length of the paint nozzle.

20. The paint nozzle according to claim 19, wherein the coating agent channel has an upstream duct section and a downstream duct section, the upstream duct section having a greater duct cross section than the downstream duct section.

21. The paint nozzle according to claim 20, wherein the downstream duct section of the coating agent channel runs off-center in the paint nozzle in relation to the axis of rotation of the bell cup.

22. The paint nozzle according to claim 21, wherein the coating agent channel runs conically.

23. The paint nozzle according to claim 1, further comprising:

a distal nozzle section with an essentially cylindrical outer contour, a proximal nozzle section with an essentially cylindrical outer contour, and a central nozzle section, which is arranged in the axial direction between the proximal nozzle section and the distal nozzle section and tapers conically in the direction of the distal nozzle section.

24. The paint nozzle according to claim 23, wherein the annular gap into which the second rinsing agent outlet opens surrounds the central conical nozzle section of the paint nozzle.

25. The paint nozzle according to claim 24, wherein the central conical nozzle section has a cone angle which is greater than 2°.

26. The paint nozzle according to claim 25, wherein the central conical nozzle section has a cone angle which is less than 30°.

27. The paint nozzle according to claim 26, wherein the outer contour has a step at the transition from the proximal nozzle section to the distal nozzle section.

28. The paint nozzle according to claim 27, wherein the transition from the central nozzle section to the distal nozzle section is essentially step-free.

29. The paint nozzle according to claim 1, wherein a conical nozzle section is surrounded by the annular gap to be rinsed, wherein the second rinsing agent outlet opens out of the conical nozzle section and outputs the rinsing agent directly into the surrounding annular gap.

30. A bell cup for a rotary atomizer, having a distributor disc receptacle, a distributor disc, which is fastened to the distributor disc receptacle, a paint nozzle, which is inserted into the distributor disc receptacle, and an annular gap between the paint nozzle and the surrounding distributor disc receptacle, wherein the paint nozzle comprises:

a common rinsing agent channel which runs in the paint nozzle for conducting a rinsing agent for rinsing the bell cup, a first rinsing agent outlet, which is supplied with the rinsing agent by the common rinsing agent channel and is directed essentially axially forward onto a distributor disc of the bell cup, and a second rinsing agent outlet, which is supplied with the rinsing agent by the common rinsing agent channel, wherein the second rinsing agent outlet, when in the mounted state, opens into the annular gap between the distributor disc receptacle and the paint nozzle in order to clean the annular gap with the rinsing agent; and further wherein the bell cup has an external rinsing chamber in order to allow external rinsing of the bell cup with the coating agent, the paint nozzle has a third rinsing agent outlet, which is supplied with the rinsing agent by the common rinsing agent channel, and the third rinsing agent outlet conducts the rinsing agent into the external rinsing chamber.

31. A rotary atomizer having a bell cup, the bell cup comprising:

a distributor disc receptacle, a distributor disc, which is fastened to the distributor disc receptacle, a paint nozzle, which is inserted into the distributor disc receptacle, and an annular gap between the paint nozzle and the surrounding distributor disc receptacle, wherein the paint nozzle comprises:

a common rinsing agent channel which runs in the paint nozzle for conducting a rinsing agent for rinsing the bell cup, a first rinsing agent outlet, which is supplied with the rinsing agent by the common rinsing agent channel and is directed essentially axially forward onto a distributor disc of the bell cup, and a second rinsing agent outlet, which is supplied with the rinsing agent by the common rinsing agent channel, wherein the second rinsing agent outlet, when in the mounted state, opens into the annular gap between the distributor disc receptacle and the paint nozzle in order to clean the annular gap with the rinsing agent; and further wherein the bell cup has an external rinsing chamber in order to allow external rinsing of the bell cup with the coating agent, the paint nozzle has a third rinsing agent outlet, which is supplied with the rinsing agent by the common rinsing agent channel, and the third rinsing agent outlet conducts the rinsing agent into the external rinsing chamber.

* * * * *